US011705052B2

(12) United States Patent
Chang

(10) Patent No.: US 11,705,052 B2
(45) Date of Patent: Jul. 18, 2023

(54) SUB-PIXEL RENDERING METHOD FOR DISPLAY PANEL

(71) Applicant: FORCELEAD TECHNOLOGY CORP., Jhubei (TW)

(72) Inventor: Ching-Tsun Chang, Jhubei (TW)

(73) Assignee: ForceLead Technology Corp., Jhubei (TW)

( * ) Notice: Subject to any disclaimer, the term of this patent is extended or adjusted under 35 U.S.C. 154(b) by 0 days.

(21) Appl. No.: 17/829,975

(22) Filed: Jun. 1, 2022

(65) Prior Publication Data

US 2023/0141954 A1 May 11, 2023

Related U.S. Application Data

(60) Provisional application No. 63/195,365, filed on Jun. 1, 2021.

(51) Int. Cl.
*G09G 3/20* (2006.01)

(52) U.S. Cl.
CPC ..... *G09G 3/2074* (2013.01); *G09G 2320/02* (2013.01); *G09G 2320/0626* (2013.01)

(58) Field of Classification Search
CPC ..... G09G 3/2074; G09G 2320/02; G09G 2320/0626
See application file for complete search history.

(56) References Cited

U.S. PATENT DOCUMENTS

2015/0070403 A1* 3/2015 Kim ..... G09G 3/20 345/690
2016/0027359 A1 1/2016 Guo et al.
2016/0171939 A1* 6/2016 Na ..... G09G 3/3607 345/88
2018/0039856 A1* 2/2018 Hara ..... G06V 10/82
2018/0158394 A1 6/2018 Guo et al.
2018/0240437 A1* 8/2018 Miller ..... H04N 19/40
2022/0028321 A1* 1/2022 Shin ..... B60K 35/00

FOREIGN PATENT DOCUMENTS

CN 102622981 A 8/2012
CN 106210444 A * 12/2016 ..... H04N 5/144
CN 108074539 A 5/2018
CN 108701235 A * 10/2018 ..... G06T 1/20
CN 109192084 A 1/2019
CN 110945582 A 3/2020
CN 113409726 A * 9/2021

OTHER PUBLICATIONS

First Office Action mailed to Taiwanese Counterpart Application 111120524 dated Apr. 21, 2023.
Search Report mailed to Taiwanese Counterpart Application 111120524 dated Apr. 21, 2023.

* cited by examiner

*Primary Examiner* — Ricardo Osorio
(74) *Attorney, Agent, or Firm* — Rosenberg, Klein & Lee

(57) ABSTRACT

The present application relates to a sub-pixel rendering method for a display panel, which determines sampling locations according to arrangement locations of the sub-pixels, converts an input image according to a human vision model for correspondingly generating an adjustment luminance data, and samples a plurality of adjustment luminance value of the adjustment luminance data according to the sampling locations. Thereby, corresponded target grayscale data is generated. Thus, the input image is prevented from distortion.

5 Claims, 9 Drawing Sheets

SUB-PIXEL RENDERING METHOD FOR DISPLAY PANEL

FIELD OF THE INVENTION

The present application relates generally to a rendering method, and particularly to a sub-pixel rendering method for a display panel.

BACKGROUND OF THE INVENTION

In a general display panel, sub-pixel structures are arranged in a matrix with each responsible for one of red, green, and blue colors. Three sub-pixel structures with each of the red, green, and blue colors may form a pixel. Nonetheless, not all display panels arrange a pixel with three sub-pixel structures. Thereby, the displaying quality is inferior.

To solve the above problem of inferior quality, according to the prior art, some manufacturers cooperated to propose a rendering technology for primary color sub-pixels. According to the technology, for a specific arrangement of the primary color sub-pixels, a specific sub-pixel rendering algorithm is designed. Unfortunately, the sub-pixel rendering algorithm according to the prior art does not include the human vision model. In other words, it neglects the visual perception of human eyes.

Accordingly, the present application provides a sub-pixel rendering method for a display panel. The method converts an input grayscale data of an input image according to a human vision model and gives adjustment luminance data for generating better target grayscale data. With the better target grayscale data, the grayscale images displayed on the display panels may comply with the visual perception of human eyes.

SUMMARY

An objective of the present application is to provide a sub-pixel rendering method for a display panel. The method converts an input grayscale data of an input image according to a human vision model for generating an adjustment luminance data, and samples the adjustment luminance values according to the sampling locations corresponding to the arrangement locations of the sub-pixels. Thereby, target grayscale values complying with the visual perception of human eyes will be given.

The present application discloses a sub-pixel rendering method for a display panel, which determines a plurality of sampling locations according to a plurality of arrangement locations of sub-pixels, converts an input grayscale data of an input image according to a human vision model for generating an adjustment luminance data, samples a plurality of adjustment luminance values of the adjustment luminance data according to the sampling locations, and generates a target grayscale data according to the sampled adjustment luminance values. The target grayscale data includes a plurality of target grayscale values corresponding to the sub-pixels. Thereby, the target grayscale values may comply with the visual perception of human eyes by avoiding distortion of the input image.

DETAILED DESCRIPTION

In order to make the structure and characteristics as well as the effectiveness of the present application to be further understood and recognized, the detailed description of the present application is provided as follows along with embodiments and accompanying figures.

Since the sub-pixel rendering algorithm according to the prior art does not comply with the visual perception of human eyes, the present application proposes a sub-pixel rendering method for display panel for giving preferred target grayscale data. Thereby, the grayscale images displayed on the display panel may comply with the visual perception of human eyes.

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Besides, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In the following, the properties and the accompanying structure of the sub-pixel rendering method for display panel disclosed in the present application will be further described.

Figure 1:
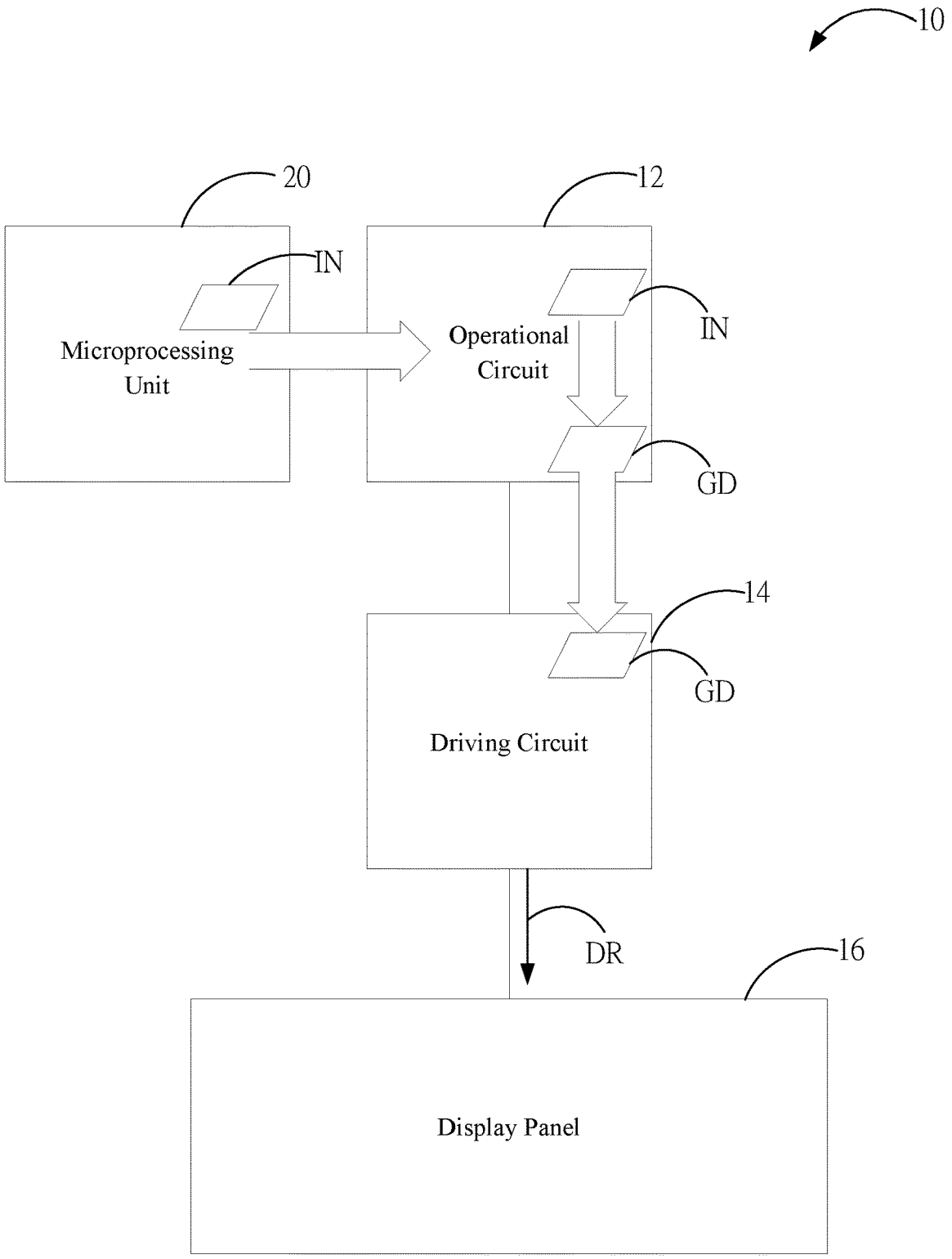
FIG. 1 shows a block diagram of the sub-pixel rendering method according to an embodiment of the present application.

First, please refer to FIG. 1, which shows a block diagram of the sub-pixel rendering method according to an embodiment of the present application. As shown in the figure, the display device 10 applying the sub-pixel rendering method for display panel according to the present application comprises an operational circuit 12, a driving circuit 14, and a display panel 16. The operational circuit 12 receives an input image IN from a microprocessing unit 20 for performing a sub-pixel rendering operation RP on the input image IN and generating a target grayscale data to the driving circuit 14. For example, the microprocessing unit 20 inputs a digital image to the operational circuit 12. The driving circuit 14 generates a driving signal DR to the display panel 16 according to the target grayscale data GD and drives the display panel 16 to display the grayscale image corresponding to the input image IN. The operational circuit 12 according to the present embodiment may be a circuit with logic and floating-point operating capabilities. In addition, the operational circuit 12 according to the present application may be further integrated in the driving circuit 14.

Figure 2:
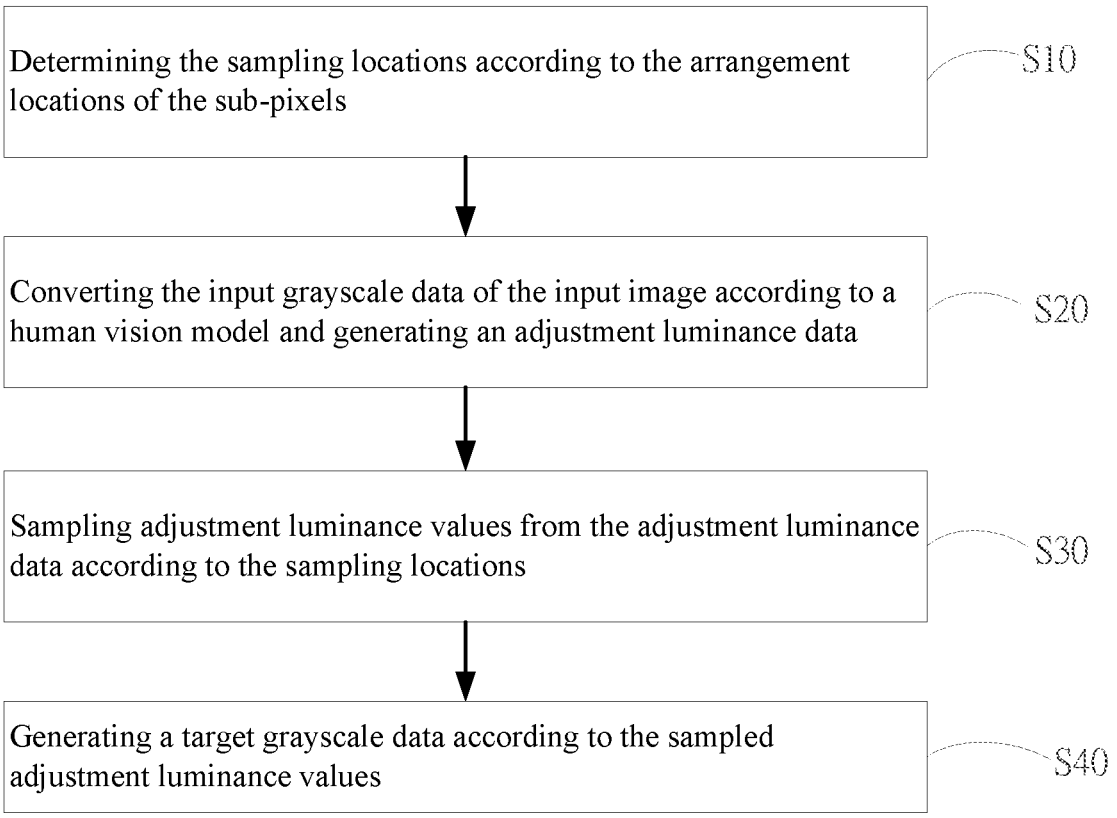
FIG. 2 shows a flowchart of the sub-pixel rendering method according to an embodiment of the present application.

Please refer to FIG. 2, which shows a flowchart of the sub-pixel rendering method according to an embodiment of the present application. As shown in the figure, the sub-pixel rendering method according to the present application refers to the operating and processing processes of the operational circuit 12, comprising steps of:

Step S10: Determining the sampling locations according to the arrangement locations of the sub-pixels;

Step S20: Converting the input grayscale data of the input image according to a human vision model and generating an adjustment luminance data;

Step S30: Sampling adjustment luminance values from the adjustment luminance data according to the sampling locations; and Step S40: Generating a target grayscale data according to the sampled adjustment luminance values.

Figure 3:
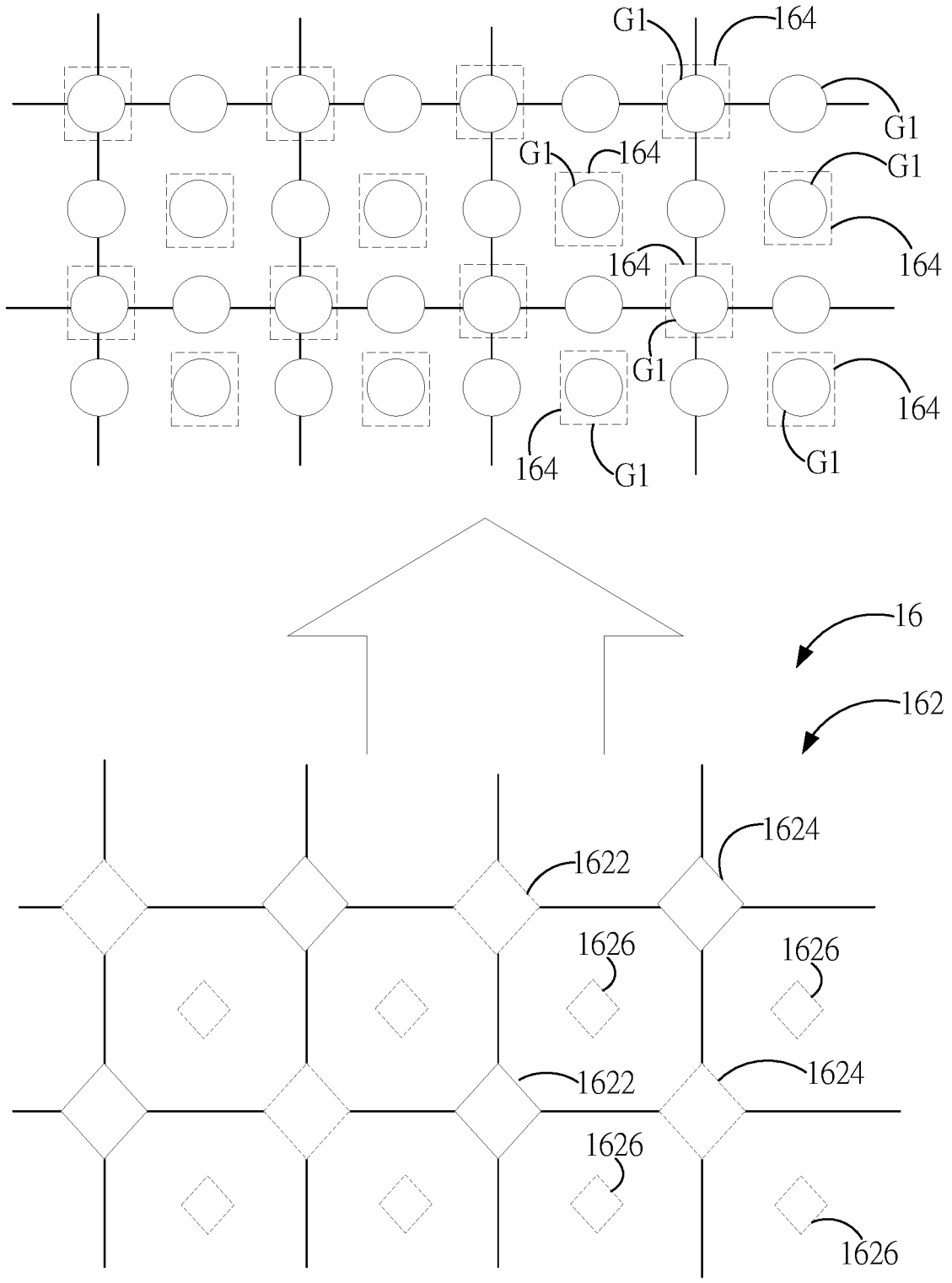
FIG. 3 shows a schematic diagram of sub-pixel arrangement in the sub-pixel rendering method according to an embodiment of the present application.

In the step S10, the operational circuit 12 acquires a plurality of sampling locations 164 corresponding to the input grayscale values G1 according to the arrangement locations of the sub-pixels 162 of the display panel 16, as shown in FIG. 3. The operational circuit 12 determines the number of the sampling locations 164 according to the arrangement locations of the sub-pixels 162 and a display resolution of the display panel 16. As shown in FIG. 3, the sub-pixels 162 according to the present embodiment include a plurality of first sub-pixels 1622, a plurality of second sub-pixels 1624, and a plurality of third sub-pixels 1626. According to the present embodiment, the first sub-pixels 1622 are red pixels; the second sub-pixels 1624 are blue pixels; and the third sub-pixels 1626 are green pixels. Besides, the first sub-pixels 1622, the second sub-pixels 1624, and the third sub-pixels 1626 have their corresponding sampling locations 164, respectively. Nonetheless, the present application is not limited to the embodiment. It may be applied to special display devices with other display conditions, for example, display panels with various arrangements of the sub-pixels. The operational circuit 12 determines the sampling locations 164 according to the arrangement locations of the sub-pixels 162.

Figure 4:
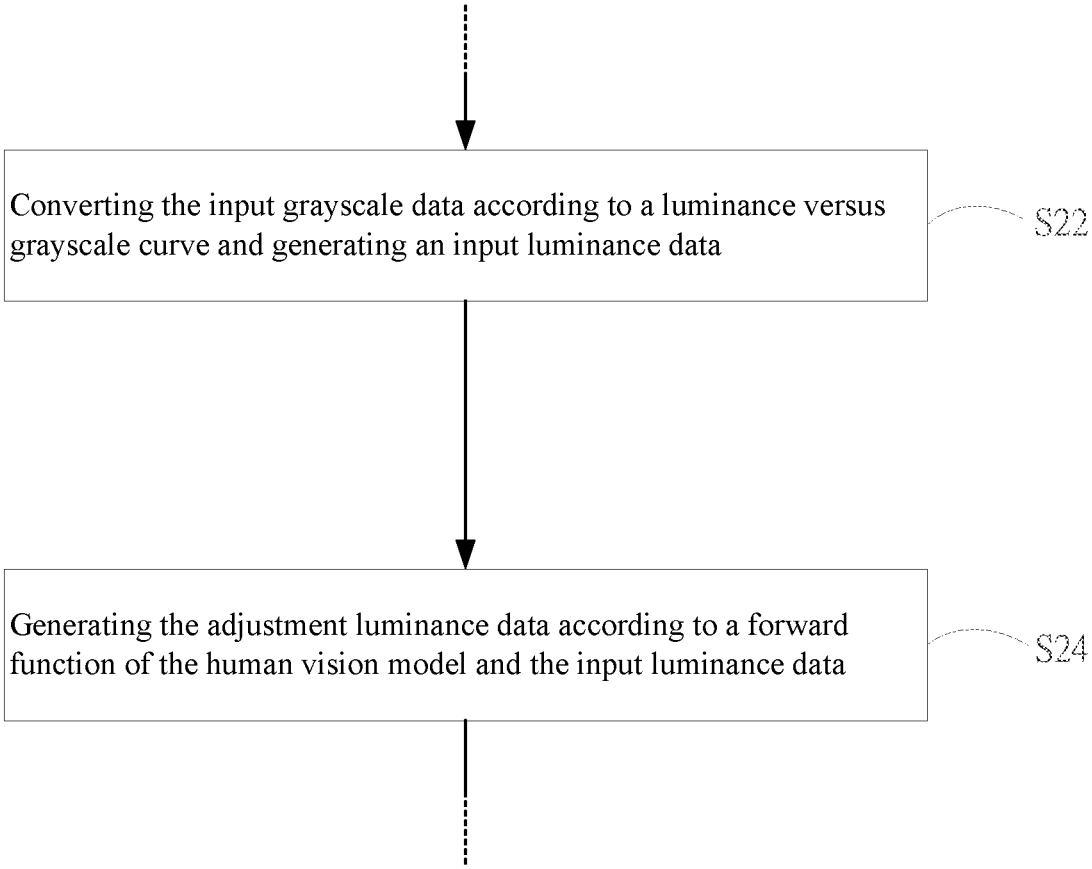
FIG. 4 shows a flowchart of conversion of human vision in the sub-pixel rendering method according to an embodiment of the present application.
Figure 5:
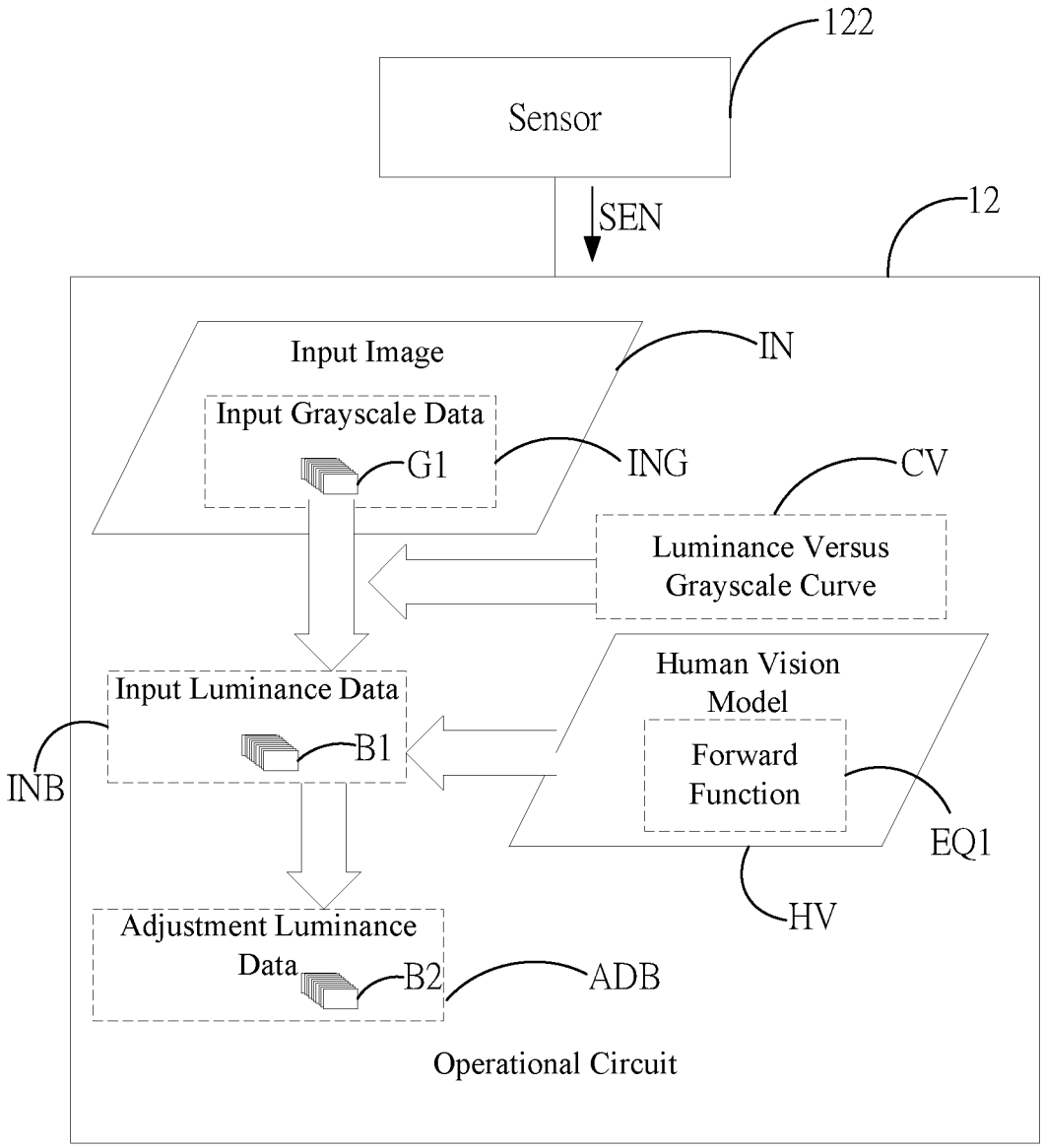
FIG. 5 shows a schematic diagram of conversion steps in the sub-pixel rendering method according to an embodiment of the present application.

Next, in the step S20, the operational circuit 12 converts the input grayscale values G1 of the input grayscale data ING according to a human vision model HV, as shown in FIG. 5. As shown in FIG. 4, the step S20 includes the following steps:

Step S22: Converting the input grayscale data according to a luminance versus grayscale curve and generating an input luminance data;

Step S24: Generating the adjustment luminance data according to a forward function of the human vision model and the input luminance data.

Figure 6:
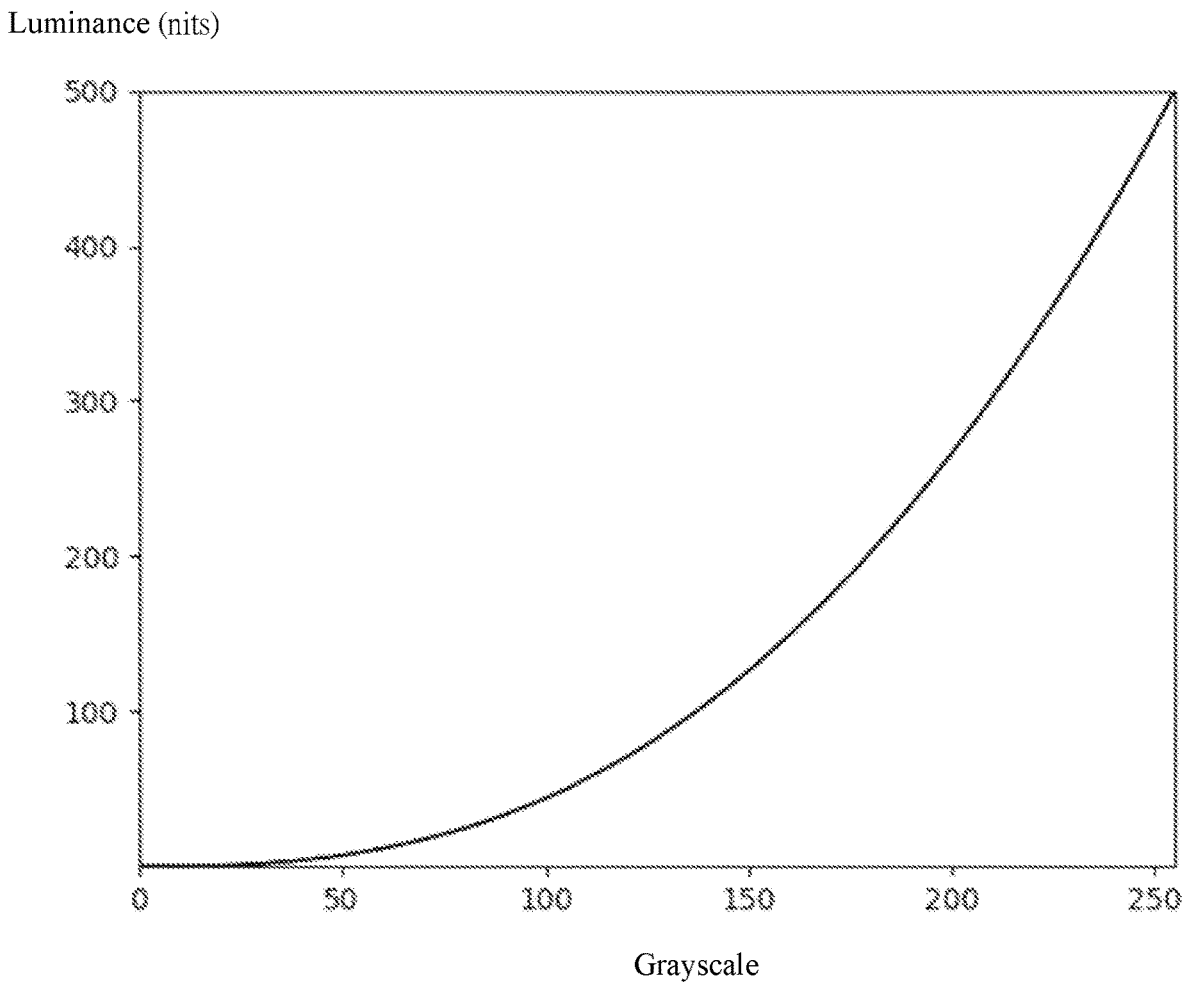
FIG. 6 shows a curve of luminance versus grayscale in the sub-pixel rendering method according to an embodiment of the present application.

In the step S22, as shown in FIG. 5, the input grayscale data ING of the input image IN includes a plurality of input grayscale values G1. The operational circuit 12 converts the input grayscale values G1 to a plurality of input luminance values B1 according to a luminance versus grayscale curve CV as shown in FIG. 6 and thus generating the input luminance data INB.

In the step S24, as shown in FIG. 5, the operational circuit 12 adjusts the input luminance values B1 of the input luminance data INB according to a forward function EQ1 of the human vision model HV and generates an adjustment luminance data ADB. The adjustment luminance data ADB includes a plurality of adjustment luminance values B2. According to the present embodiment, the operational circuit 12 adopts the forward function EQ1 of the human vision model HV as the sampling function for sampling the input luminance values. The sampling process is similar to convolution operations and thus giving the adjustment luminance values B2. The human vision model HV according to the present application is a function of space, wavelength, environment, and physiology and determines the pupil size and the brightness and chromatic adaptation of optic nerves according to the ambient light.

Figure 7:
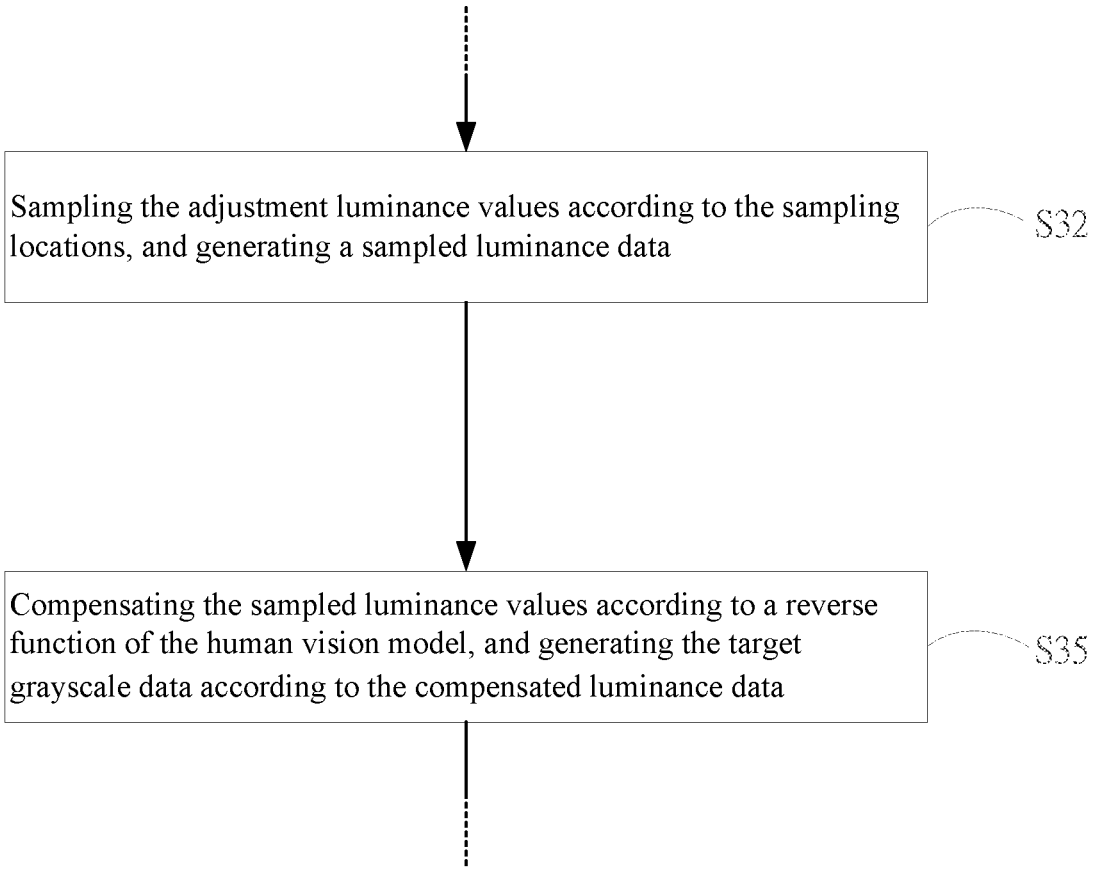
FIG. 7 shows a flowchart of sampling steps in the sub-pixel rendering method according to an embodiment of the present application.

Next, in the step S30, the operation circuit 12 samples the adjustment luminance values B2 according to the sampling locations 164 corresponding to the sub-pixels 162 as described above. Furthermore, as shown in FIG. 7, the step S30 may include steps of:

Step S32: Sampling the adjustment luminance values according to the sampling locations; and Step S35: Compensating the sampled luminance values according to a reverse function of the human vision model.

Figure 8:
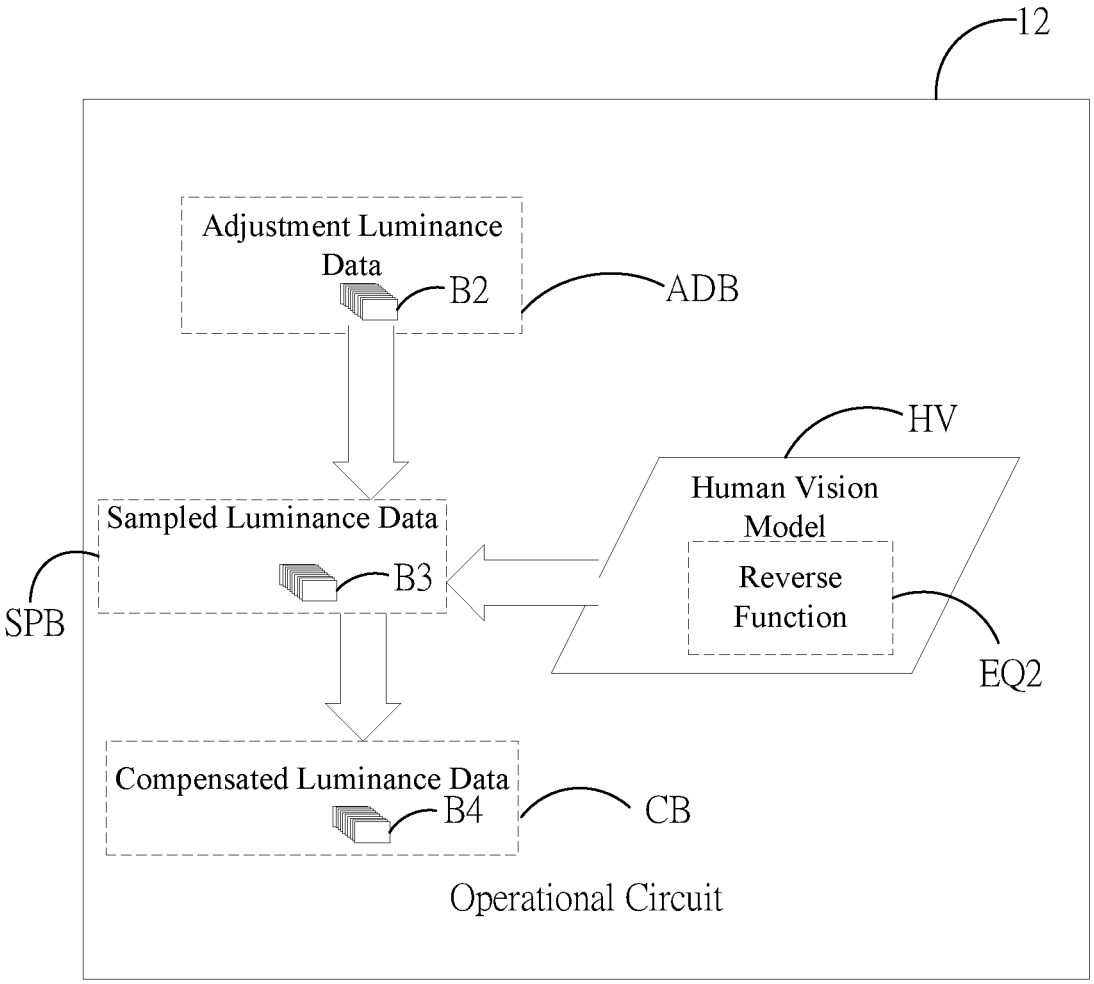
FIG. 8 shows a schematic diagram of sampling steps in the sub-pixel rendering method according to an embodiment of the present application.

In the step S32, as shown in FIG. 8, the operational circuit 12 samples the adjustment luminance values B2 corresponding to the input grayscale values G1 according to the sampling locations 164 corresponding to the sub-pixels 162 as described above and generates a plurality of sampled luminance values B3 and thus generates the sampled luminance data SPB. In other words, the operational circuit 12 samples the adjustment luminance values B2 at corresponding locations according to the sampling locations 164 corresponding to the arrangement locations of the sub-pixels 162 and generates the sampled luminance values B3 and the sampled luminance data SPB. In general, the number of the input grayscale values G1 of the input image IN is greater than the number of the sub-pixels 162 of the display panel 16. In addition, each input grayscale value G1 corresponds to its location, as shown in FIG. 3. Once the resolution of the input image IN is different, the number of the input grayscale values G1 of the input image IN will be different. Thereby, the sampling locations 164 will be different correspondingly. For example, if the resolution is larger, the number of the input grayscale values G1 will be more. Correspondingly, the number of the input grayscale values G1 distributed among the sampling locations 164 will be more. Contrarily, if the resolution is smaller, the number of the input grayscale values G1 will be less. Correspondingly, the number of the input grayscale values G1 distributed among the sampling locations 164 will be less. Thereby, the operational circuit 12 samples the adjustment luminance values B2 according to the sampling locations 164 determined by the resolution of the display panel 16 and the arrangement locations of the sub-pixels 162. Namely, for each sub-pixel 162, the operational circuit 12 samples one of the adjustment luminance values B2 where the location corresponding to the location of the sub-pixel 162. Accordingly, even if the resolution of the display panel 16 is different from the number of the sub-pixels corresponding to the input image IN, the driving circuit 14 still may drive the display panel 16 to display the grayscale image corresponding to the input image IN according to the target grayscale data GD.

In the step S35, the operational circuit 12 compensates the sampled luminance values B3 according to a reverse function EQ2 of the human vision model and generates the compensated luminance values B4, and therefore generates compensated luminance data CB. To elaborate, the operational circuit 12 uses each of the sampling location 164 as center and samples the luminance values surrounding the center and compensates the luminance values of each sampling location 164 according to the reverse function EQ2. Thereby, the sampled luminance values B3 are compensated and hence generating the compensated luminance values B4.

Figure 9:
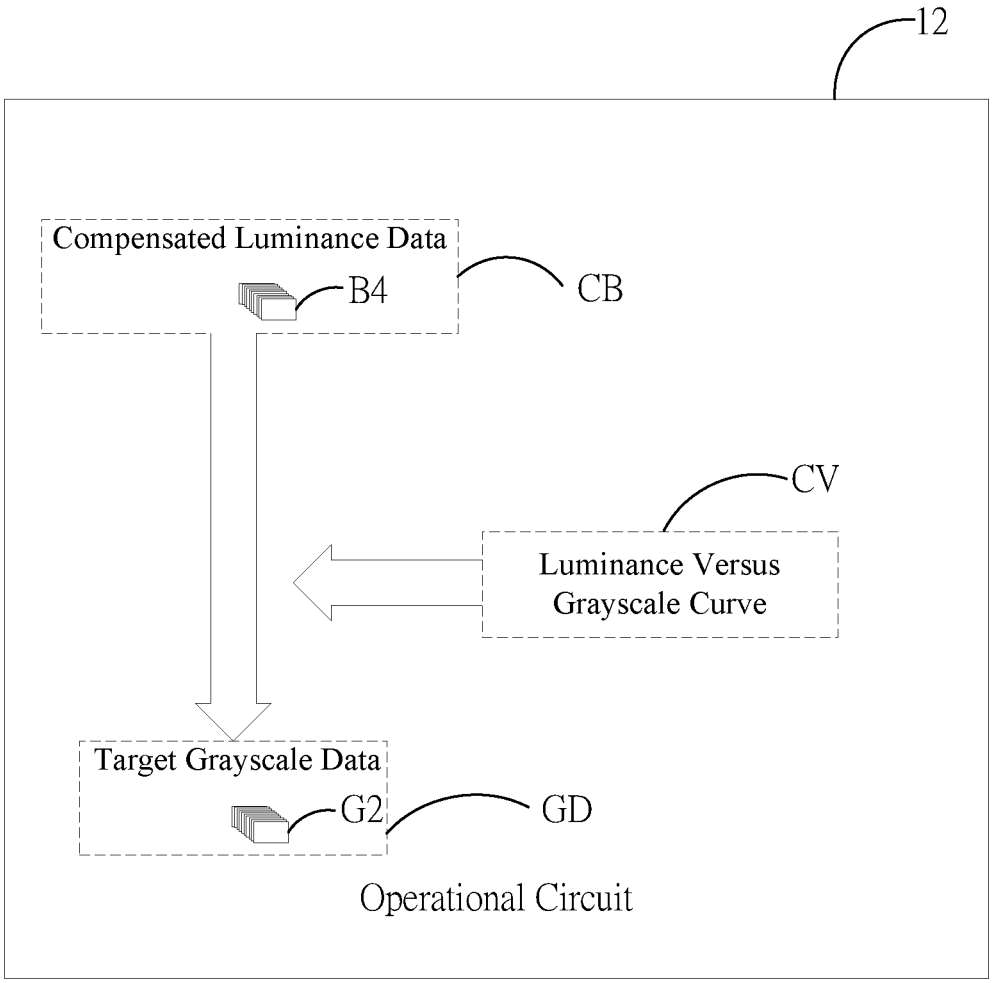
FIG. 9 shows a schematic diagram of converting luminance to grayscale in the sub-pixel rendering method according to an embodiment of the present application.

Next, in the step S40, as shown in FIG. 9, the operational circuit 12 converts the compensated luminance data CB to the target grayscale data GD according to the luminance versus grayscale curve CV shown in FIG. 6. In other word, the operational circuit 12 converts the compensated luminance values B4 to the target grayscale values G2 according to the luminance versus grayscale curve CV shown in FIG. 6 and thus completing low-distortion image rendering. Then the driving circuit 14 generates the driving signal DR according to the target grayscale data GD for driving the display panel 16.

Moreover, in the step S24, as shown in FIG. 5, the present application may further comprise a sensor 122 coupled to the operational circuit 12. The sensor 122 senses ambient conditions and provides a sensing signals SEN to the operational circuit 12 for modifying the forward function EQ1 of the human vision model HV, and therefore the forward function EQ1 complies with the ambient conditions. For example, once the ambient brightness is different, the forward function EQ1 will be different. Consequently, the operational circuit 12 modifies the forward function EQ1 dynamically according to the ambient conditions.

To sum up, the present application provides the sub-pixel rendering method for display panel. The method converts the input grayscale data of the input image to the input luminance data and adjusts the input luminance data according to the forward function of the human vision model for generating the adjustment luminance data. Then the method samples the adjustment luminance data according to the sampling locations and generates the sampled luminance data. Next, according to the reverse function of the human vision model, the method compensates the sampled luminance data and generates the compensated luminance data for generating the target grayscale data. The driving circuit drives the display panel according to the target grayscale values of the target grayscale data. Thereby, in addition to providing target grayscale values complying with the resolution of the display panel for driving the sub-pixels of the display panel, the grayscale images displayed on the display panel may comply with the visual perception of human eyes.

Accordingly, the present application conforms to the legal requirements owing to its novelty, nonobviousness, and utility. However, the foregoing description is only embodiments of the present application, not used to limit the scope and range of the present application. Those equivalent changes or modifications made according to the shape, structure, feature, or spirit described in the claims of the present application are included in the appended claims of the present application.

The invention claimed is:

1. A sub-pixel rendering method for a display panel, comprising: determining a plurality of sampling locations according to a plurality of arrangement locations of a plurality of sub-pixels; converting an input grayscale data of an input image according to a luminance versus grayscale curve and generating an input luminance data, said input luminance data including a plurality of input luminance values; and generating an adjustment luminance data according to a forward function of a human vision model and said input luminance data, said input grayscale data including a plurality of input grayscale values, and said adjustment luminance data including a plurality of adjustment luminance values; sampling said adjustment luminance values from said adjustment luminance data according to said sampling locations; and generating a target grayscale data according to said sampled adjustment luminance values, said target grayscale data including a plurality of target grayscale values, and said target grayscale values corresponding to said sub-pixels.

2. The sub-pixel rendering method for the display panel of claim 1, further comprising sensing ambient conditions and modifying said forward function of said human vision model.

3. The sub-pixel rendering method for the display panel of claim 1, further comprising compensating said sampled adjustment luminance values according to a reverse function of said human vision model and generating said target grayscale values according to said compensated adjustment luminance values.

4. The sub-pixel rendering method for the display panel of claim 1, further comprising converting said sampled adjustment luminance values according to a luminance versus grayscale curve and generating said target grayscale data.

5. The sub-pixel rendering method for the display panel of claim 1, further comprising determining said sampling locations according to said arrangement locations of said sub-pixels and a display resolution of said display panel.

* * * * *